US007507054B2

(12) United States Patent
Fithian et al.

(10) Patent No.: US 7,507,054 B2
(45) Date of Patent: Mar. 24, 2009

(54) PRE-SLOPED TRENCH DRAIN SYSTEM

(75) Inventors: Paul Charles Fithian, Long Beach, IN (US); Todd J. Holloway, Michigan City, IN (US)

(73) Assignee: Lighthouse Industries, Inc., Michigan City, IN (US)

( * ) Notice: Subject to any disclaimer, the term of this patent is extended or adjusted under 35 U.S.C. 154(b) by 99 days.

(21) Appl. No.: 11/489,229

(22) Filed: Jul. 19, 2006

(65) Prior Publication Data

US 2008/0019776 A1 Jan. 24, 2008

(51) Int. Cl.
*E02B 5/00* (2006.01)

(52) U.S. Cl. ..... 405/118; 405/119; 405/80; 404/2; 264/219; 264/220; 264/297.1; 264/297.2; 264/297.8

(58) Field of Classification Search ..... 405/80, 405/118, 126, 119, 81; 404/2, 3, 4, 5; 472/116, 472/117

See application file for complete search history.

(56) References Cited

U.S. PATENT DOCUMENTS 5,066,165 A 11/1991 Wofford et al.
5,213,438 A 5/1993 Barenwald
5,226,748 A 7/1993 Barenwald et al.
5,340,234 A 8/1994 Rossi et al.
5,529,436 A 6/1996 Meyers
5,718,537 A 2/1998 Becker et al.
5,803,662 A * 9/1998 Gunter ..... 405/119
5,971,662 A 10/1999 Becker et al.
6,000,881 A 12/1999 Becker et al.
6,027,283 A 2/2000 Schweinberg et al.
6,113,311 A 9/2000 Becker et al.

(Continued)

OTHER PUBLICATIONS

NDS Dura Slope Trench Drain System product brochure, pp. 2, 4, 5,, 7, 11, undated.

(Continued)

*Primary Examiner*—John Kreck
*Assistant Examiner*—Sean D Andrish
(74) *Attorney, Agent, or Firm*—John S. Paniaguas; Katten Muchin Rosenman LLP

(57) ABSTRACT

A below grade trench drain system and a method for making the trench drain system is disclosed which does not rely on the contractor's prowess to dig a trench with a proper slope. The trench drain system, in accordance with the present invention, includes a plurality of modular trench sections formed with a uniform exterior height and an interior fluid channel formed with a pre-sloped floor. As such, the trench drain system, in accordance with the present invention, can be installed in a level trench, which greatly simplifies installation by the contractor and ensures that the trench drain will be installed with the proper slope. The modular trench sections can be coupled together forming a trench drain with a continuous slope or alternatively coupled with modular trench sections with no slope to form a stepped slope. The configuration of the modular trench sections allows the modular trench sections to form a trench drain system sloped in different directions to enable connections to the common drain in the center as well at both ends. As such, the trench drain system provides more configurations for connections to the common drain system thus improving the flexibility of the system and at the same time provide a trench drain system which does not depend on the installation prowess of the installation contractor.

24 Claims, 19 Drawing Sheets

U.S. PATENT DOCUMENTS

| | | | | |
|---|---|---|---|---|
| 6,280,117 | B1 * | 8/2001 | Obermeyer et al. | 405/119 |
| 6,595,720 | B2 | 7/2003 | Humphries et al. | |
| 6,612,780 | B2 | 9/2003 | Dahowski et al. | |
| 2005/0025572 | A1 | 2/2005 | Sanfilippo et al. | |

OTHER PUBLICATIONS

Zurn Perma-Trench "Installation Instructions," pp. 1-16; Jun. 28, 2000.

Zurn Z-886 "6" Wide Trench Drain System, Drawing No. 60355, Rev. F, Mar. 12, 2004.

* cited by examiner

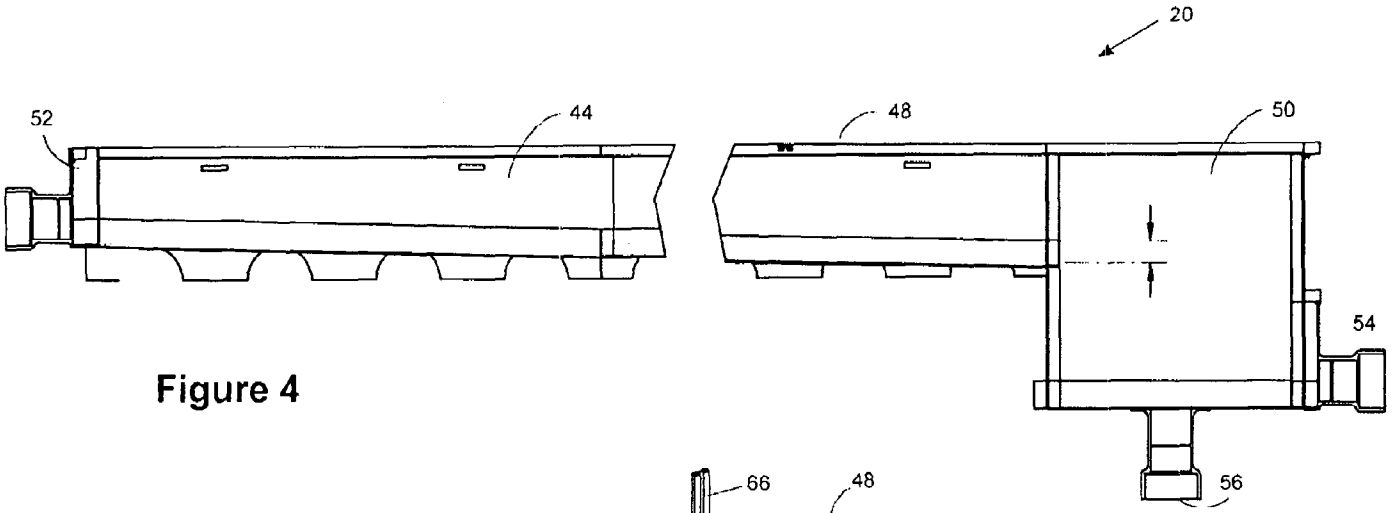
Figure 4
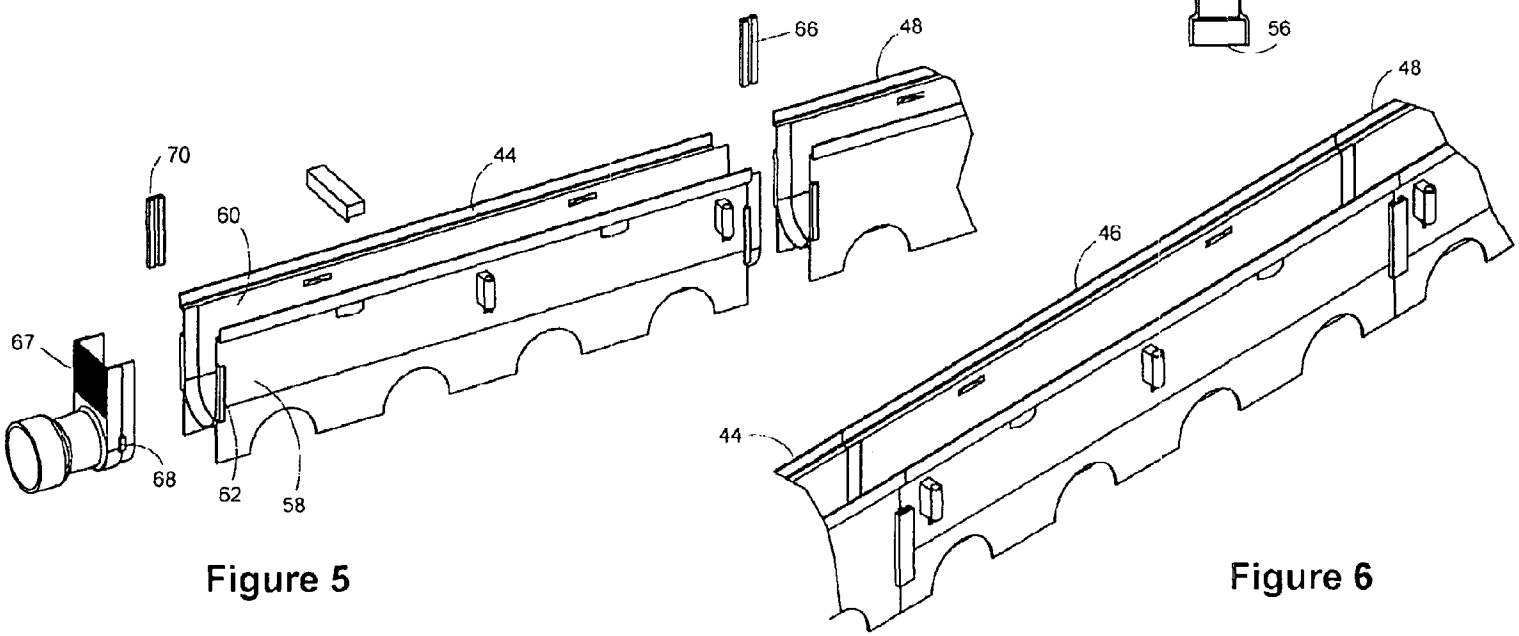
Figure 5
Figure 6

PRE-SLOPED TRENCH DRAIN SYSTEM

BACKGROUND OF THE INVENTION

1. Field of the Invention

The present invention relates to a trench drain system and a method for manufacturing a trench drain system and more particularly to a pre-sloped below grade trench drain system which includes a plurality of molded modular sections, each modular section formed with a uniform exterior height and an interior pre-sloped fluid channel, the modular sections being configured to be easily coupled together to form trench drains of various lengths to be received in a level trench forming a trench drain with a continuous or stepped slope in one direction or sloped in two directions; the molded modular sections being formed from a master mold and one or more mold inserts in order to reduce the cost to mold the modular trench drain sections.

2. Description of the Prior Art

Trench drain systems are known in the art. Examples of such trench drain systems are disclosed in U.S. Pat. Nos. 5,066,165; 5,213,438; 5,226,748; 5,340,234; 5,529,436; 5,718,537; 5,971,662; 6,000,881; 6,027,283; 6,113,311; 6,595,720; and 6,612,780 as well as US Patent Application Publication No. US 2005/0025572 A1, all hereby incorporated by reference.

Trench drains are typically used in areas where substantial amounts of water run-off are expected and are normally disposed in a recessed area in a concrete surface. Such trench drains are known to be formed in sections that are adapted to be coupled together to form trench drain systems of different lengths. Such trench drain systems are normally connected to the building drain system or municipal storm water systems (hereinafter "common drain system"). Like other drain systems in a building, trench drains are normally installed by the installation contractor so that it slopes toward the common drain system so that run-off collected by the trench drain feeds into the common drain system by gravity.

Known trench drain systems include modular trench sections, which include fluid channels formed with no slope that are open on top having either a semi-circular or U-shaped cross section. These modular trench sections are configured to be coupled together to form a trench drain system of a desired length. Normally, once the location of the trench drain is selected, the modular trench sections are coupled together by the installation contractor. The installation contractor then digs a sloping trench and places the trench drain system in the trench. The trench drain is secured in place in the ground with stakes in preparation of the pouring of the concrete. After the concrete is poured and cured, grates are placed over the modular trench sections to catch debris as well as to avoid personnel hazards.

There are many known drawbacks with known trench drain systems. First, the efficacy of such systems depends on the contractor's prowess in digging an appropriately sloped trench. If the trench is not appropriately sloped, the trench drain will not properly drain into the common drain. Secondly, the configuration of such trench drain systems offers limited connection possibilities to a common drain. For example, such systems are only configured with a connection to the common drain on one end. Moreover, because the modular trench sections are uniform in configuration and are installed by the installation contractor with a slope for gravity drainage, known trench drains cannot be used in applications in which it would be more efficient to provide a connection to the common drain either in the center or at both ends of the trench drain. Unfortunately, both configurations would require at least two modular trench sections with different slopes, which would not be possible with known trench drain systems. Thus, there is a need for a trench drain system which does not rely on the contractor's installation for proper sloping and also allows for more configurations for the connection to the common drain.

SUMMARY OF THE INVENTION

The present invention relates to a below grade trench drain system and a method for making the trench drain system which does not rely on the contractor's ability to dig a trench with a proper slope. In particular, the trench drain system in accordance with the present invention includes a plurality of modular trench sections formed with a uniform exterior height and an interior fluid channel formed with a pre-sloped floor. As such, the trench drain system in accordance with the present invention can be installed in a level trench, which greatly simplifies installation by the contractor and ensures that the trench drain will be installed with the proper slope. The modular trench sections can be coupled together forming a trench drain with a continuous slope or alternatively coupled with modular trench sections having no slope to form a stepped slope. The configuration of the modular trench sections also allows the modular trench sections to be used to form a trench drain system sloped in different directions to enable connections to the common drain in the center as well at both ends. As such, the trench drain system provides more configurations for connections to the common drain system thus improving the flexibility of the system and at the same time provide a trench drain system which does not depend on the installation prowess of the installation contractor.

DESCRIPTION OF THE DRAWING

These and other advantages of the present invention will be readily understood with reference to the following specification and attached drawing wherein:

FIG. 4 is a front elevational view of the trench drain system illustrated in FIG. 1, shown in broken away and illustrating the pre-sloped floor of the open conduit in dotted line.

FIG. 5 is an exploded isometric view of a trench drain system in accordance with the present invention shown with one trench section broken away.

FIG. 6 is an isometric view of three trench section in accordance with the present invention coupled together and shown with the end trench sections shown broken away.

DETAILED DESCRIPTION

The present invention relates to a below grade trench drain system and a method for making the trench drain system which does not rely on the contractor's prowess to dig a trench with a proper slope. In particular, the trench drain system includes a plurality of modular trench sections, each section being formed with a uniform exterior height and an interior fluid channel formed with a pre-sloped floor and open on top along its longitudinal axis. As such, the trench drain system in accordance with the present invention can be installed in a level trench, which greatly simplifies installation by the installation contractor and ensures that the trench drain will be installed with the proper slope.

The modular trench sections can be coupled together forming a trench drain with a continuous slope or alternatively coupled with modular trench sections with no slope to form a stepped slope. In accordance with an important aspect of the invention, the modular trench sections are configured to be coupled together in a manner in which the modular trench sections are sloped in different directions to enable connections to the common drain at both ends of the trench drain and in the center of the trench drain. As such, the trench drain system provides more configurations for connections to the common drain system thus improving the flexibility of the system and at the same time provides a trench drain system which does not depend on the installation prowess of the installation contractor.

Trench Drain System

Figure 1:
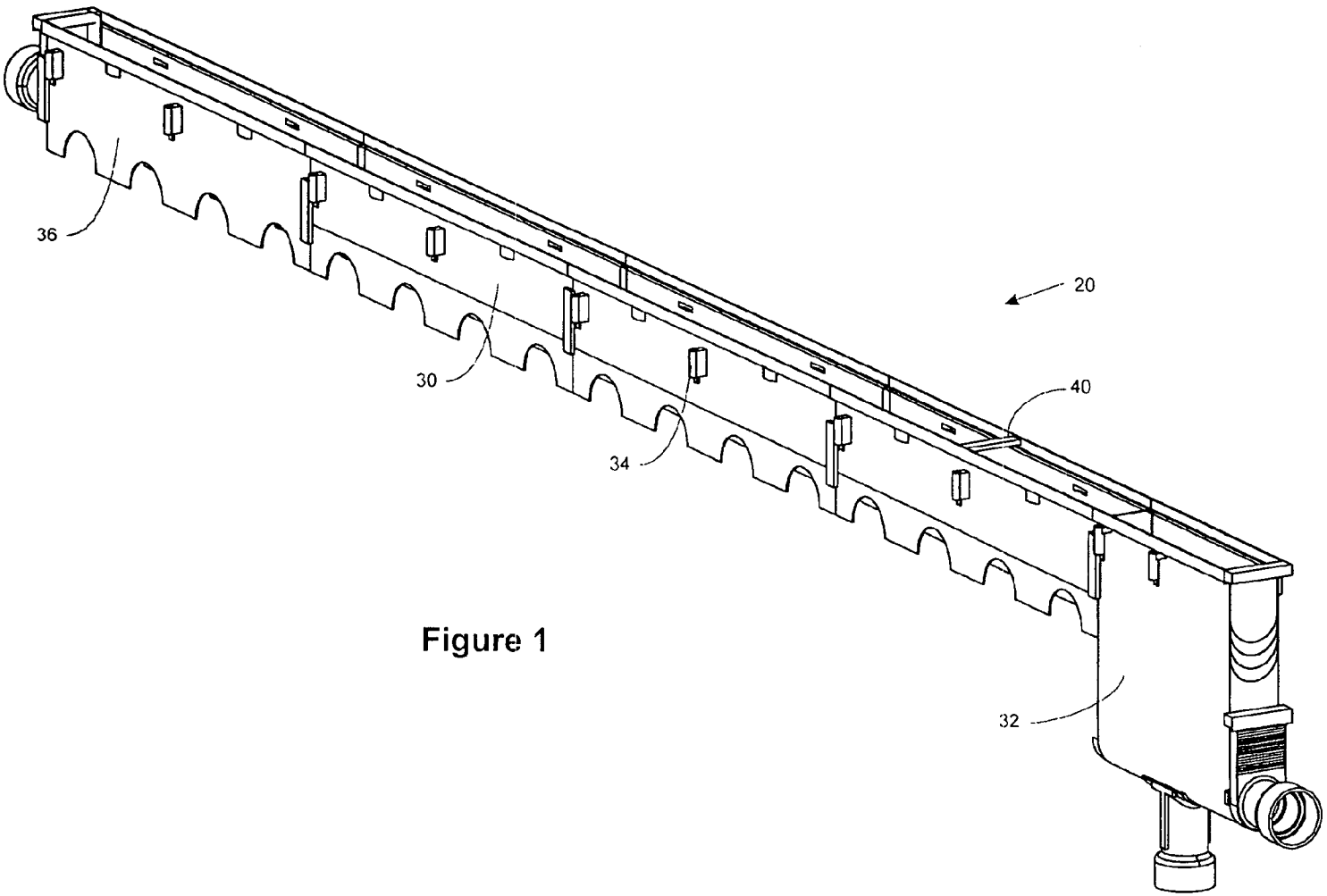
FIG. 1 is an isometric drawing of the trench drain system in accordance with the present invention shown with an exemplary number of trench sections.
Figure 2:
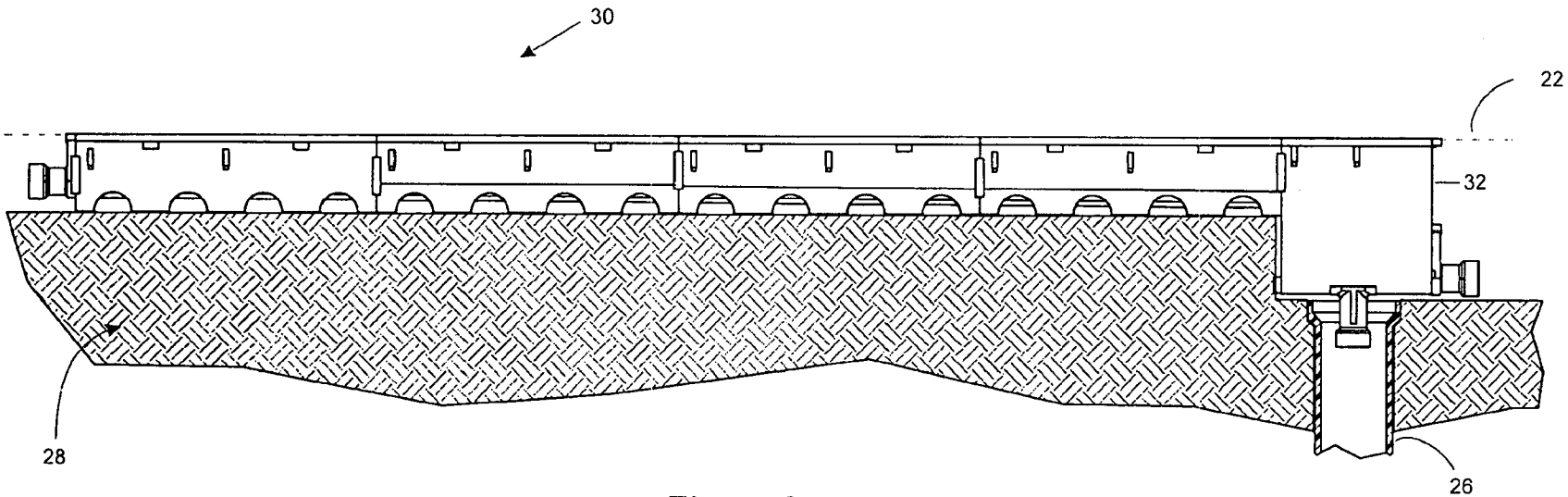
FIG. 2 is a front elevational view of the trench drain system illustrated in FIG. 1, shown connected to a common drain and installed in concrete.
Figure 3:
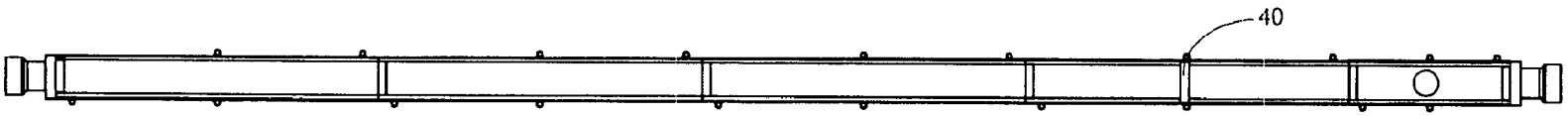
FIG. 3 is a top plan view of the trench drain system illustrated in FIG. 1.
Figure 17A:
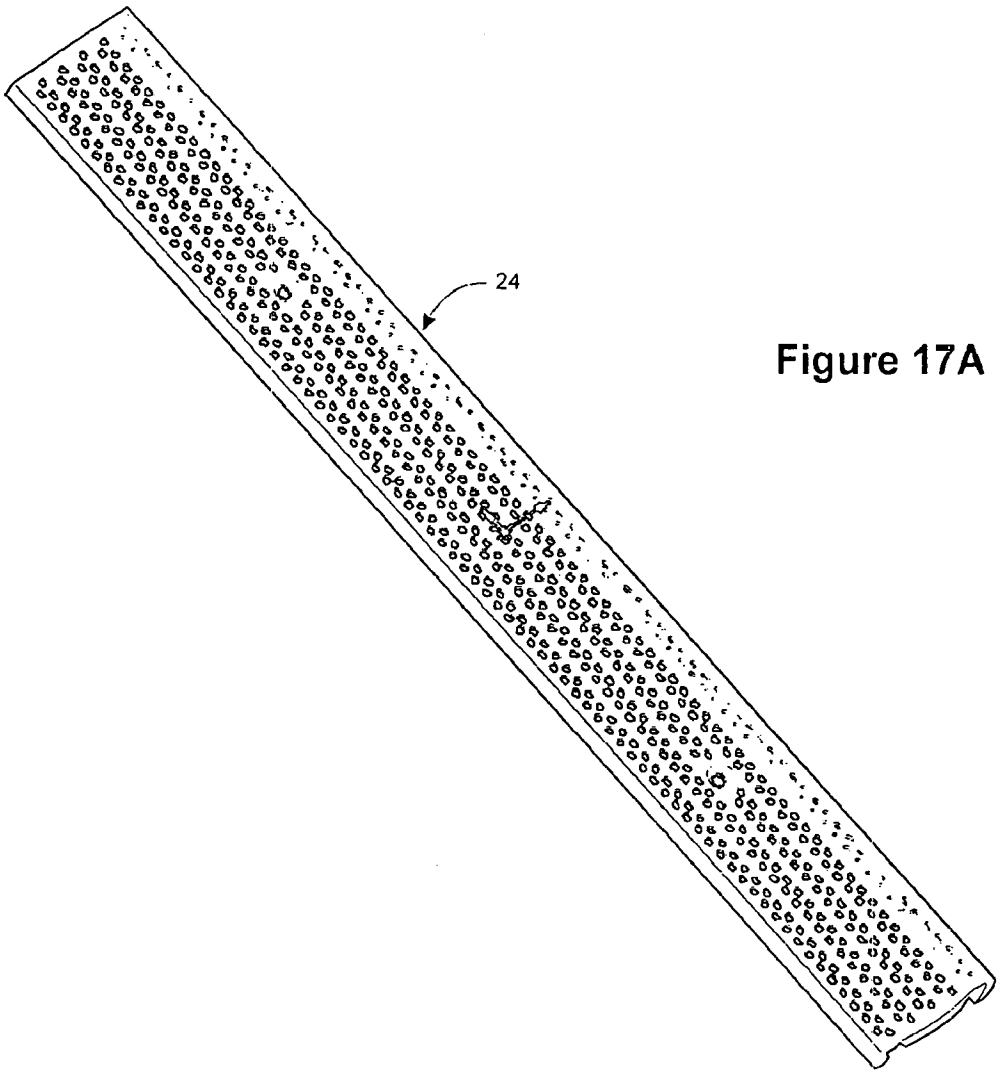
FIG. 17A is an isometric view of an exemplary grate for use with the present invention.
Figure 17B:
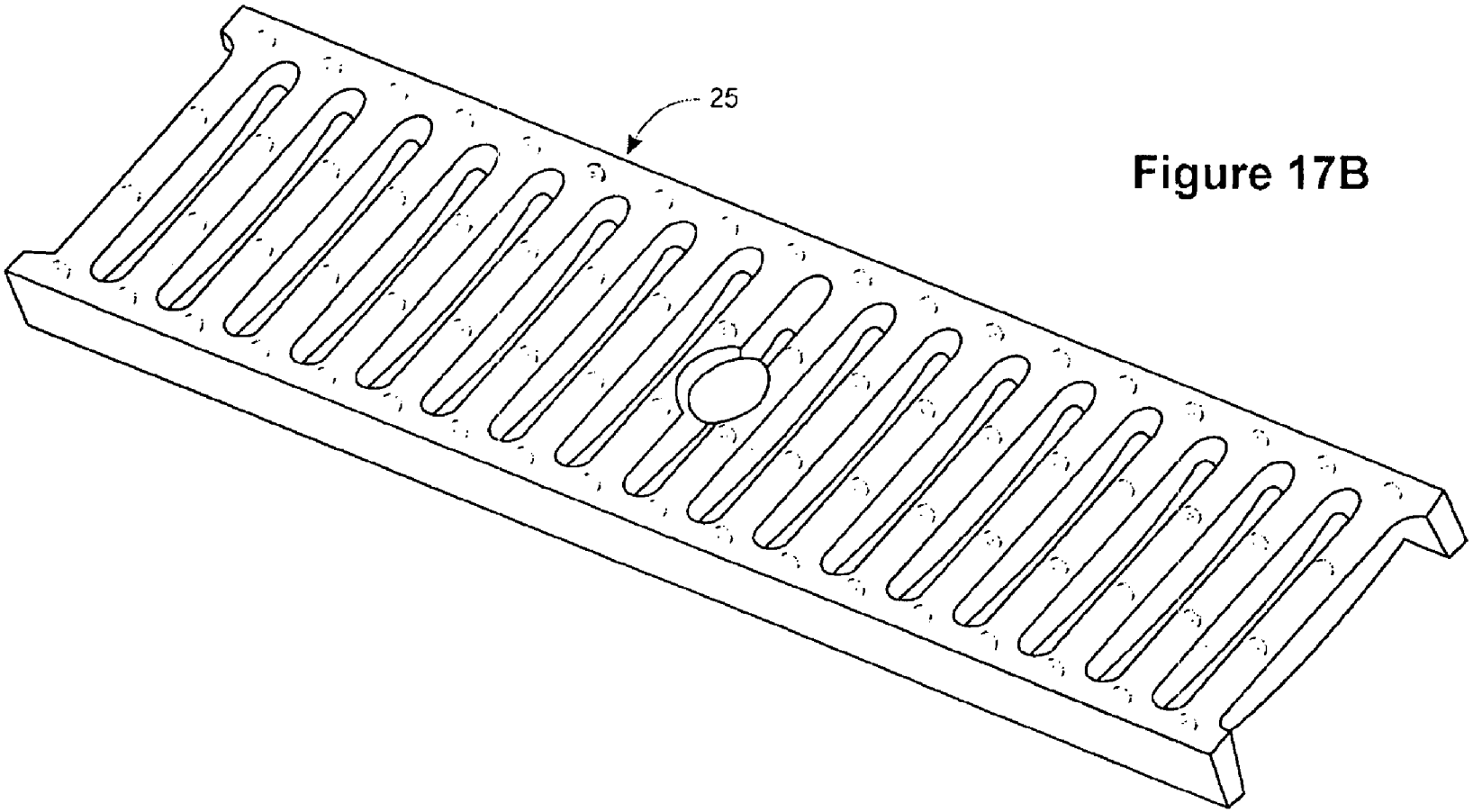
FIG. 17B is an isometric view of an exemplary alternative grate for use with the present invention.

FIGS. 1-3 illustrate an exemplary installation of a trench drain system in accordance with the present invention, generally identified with the reference numeral 20. As illustrated best in FIG. 2, the trench drain system 20 is adapted to be installed below grade 22 and covered with a grate 24, 25 (FIGS. 17A and 17B), which may be configured as illustrated in FIGS. 17A or 17B. In a typical installation, the trench drain system 20 (FIGS. 1-3) is coupled to a common drain, such as a floor drain 26 (FIG. 2), as shown, and encased in concrete 28.

The trench drain system 20 includes one or more modular trench sections, generally identified with the reference numeral 30, and may include an optional catch basin 32. The catch basin 32 is installed on the down stream end of the trench drain system 20 and is used to collect the drainage from one ore more trench drain systems 20. The modular trench sections 30 may be formed with uniform lengths, for example, 1 meter lengths, or non-uniform lengths. The modular trench sections 30 are coupled together with or without a catch basin 32 to form a trench drain system of a desired length.

The exemplary trench drain system 20 shown in FIGS. 1-3, is shown formed with four trench drain sections 30 formed with uniform length and, includes a catch basin 32. As will be discussed in more detail below, each of the modular trench sections 30 is formed with a fluid channel with a pre-sloped floor which forms a continuous slope when the modular trench sections 30 are coupled together and laid in a trench with a level slope.

In order to level the trench drain system 20 in place and hold it in place while concrete is being poured into the trench, a number of leveling sleeves 34 are formed on the exterior sidewalls 36 (FIG. 1) of each of the modular trench sections 30. Each sleeve 34 is formed with a through hole configured to receive a rebar, for example, ½" rebar. As best shown in FIG. 8D, the rebar 38 is received in the leveling sleeve 34 and pounded down in the bottom surface of the trench. The trench drain system 20 is then leveled by sliding the trench drain sections 30 up or down on the rebar 38. Once the modular trench drain sections 30 are leveled, fasteners, such as heavy duty cable ties or simply lengths of wire, are secured around the rebar 38 above and below the leveling sleeves 34, after it has been leveled. In addition to leveling trench drain sections 30, one or more spacers 40 may be provided along the length of the modular trench sections 30, as shown in FIGS. 1 and 3, to keep the sidewalls 36 spaced apart during the pouring of the concrete 28.

FIGS. 4-6 illustrate an exemplary trench drain system 20 which includes a plurality of trench drain sections 44, 46 and 48 and a catch basin 50. As shown, an outlet end cap 52 is provided on an upstream end of the trench drain section 44. A catch basin 50 is provided on the downstream end. For illustration, an outlet end cap 54 as well as a bottom pipe outlet 56 are shown attached to the catch basin 50. The outlet end cap 54 and bottom pipe outlet 56 are shown to illustrate the flexibility of the various connections to the trench drain system 42.

An important aspect of the invention is the ability to rather quickly and easily couple contiguous trench drain sections together. In particular, as will be discussed in more detail below, each trench drain sections 44, 46, 48 is formed with a pair of spaced apart exterior sidewalls 58, 60. An extending rib 62 is formed on the ends of each sidewall 58, 60 of the trench drain sections 44, 46, 48. The extending ribs 62 are formed to be generally parallel to a transverse axis of the trench drain sections 44, 46, 48. By providing the extending ribs 62 on the edges of each sidewall 58, 60 on each end of the trench drain sections 44, 46, 48, contiguous drain sections 44, 46, 48 are simply juxtaposed next to each other and secured together by way of a clip 66, which slips over the extending ribs 62 and bridges them together.

As shown best in FIG. 5, the clips 66 are also used to secure other components, such as the outlet end cap 67 to the trench drain sections 44, 46 and 48, as generally shown in FIGS. 1 and 5, as well as the catch basin 50 to the modular section 48. In particular, the outlet end cap 67 is formed with an extending rib 68. Once the outlet end cap 66 is juxtaposed adjacent to the trench drain section 44, the clip 66 is slipped over the extending rib 68 on the outlet end cap 66 as well as the extending rib 62 on the trench drain section 44 to connect these two components together. The catch basin 50 is coupled to the modular section 48 in a similar manner.

Modular Trench Drain Sections

FIGS. 7, 8A-8C, 9A-9C, 10A-10C illustrate exemplary trench drain sections. For example, referring first to FIG. 7, each trench drain section 74 includes a pair of spaced apart sidewalls 76, 78 and an interior fluid channel 80. In accordance with an important aspect of the invention, the height of the exterior sidewall 76, 78 is maintained as uniform, while the height of the floor 80 of the interior fluid channel is varied.

Figures 8A, 8B, 8C:
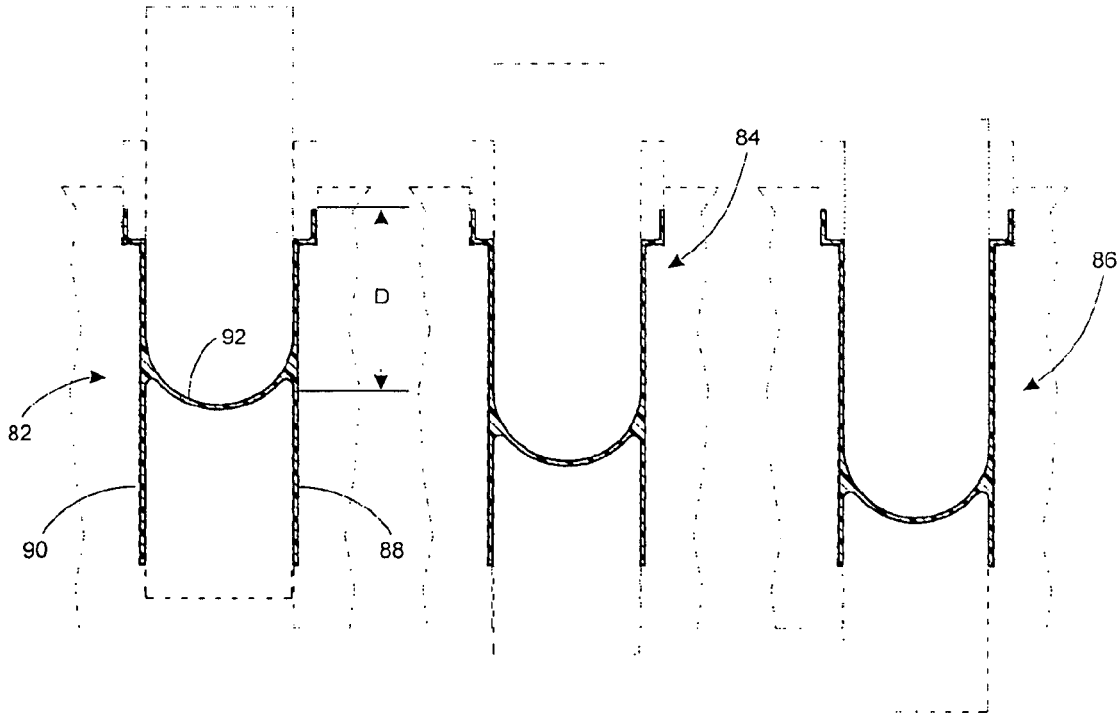
FIGS. 8A-8C illustrate three different exemplary trench sections with different pre-sloped floor heights and uniform exterior heights in accordance with the present invention.
Figure 8D:
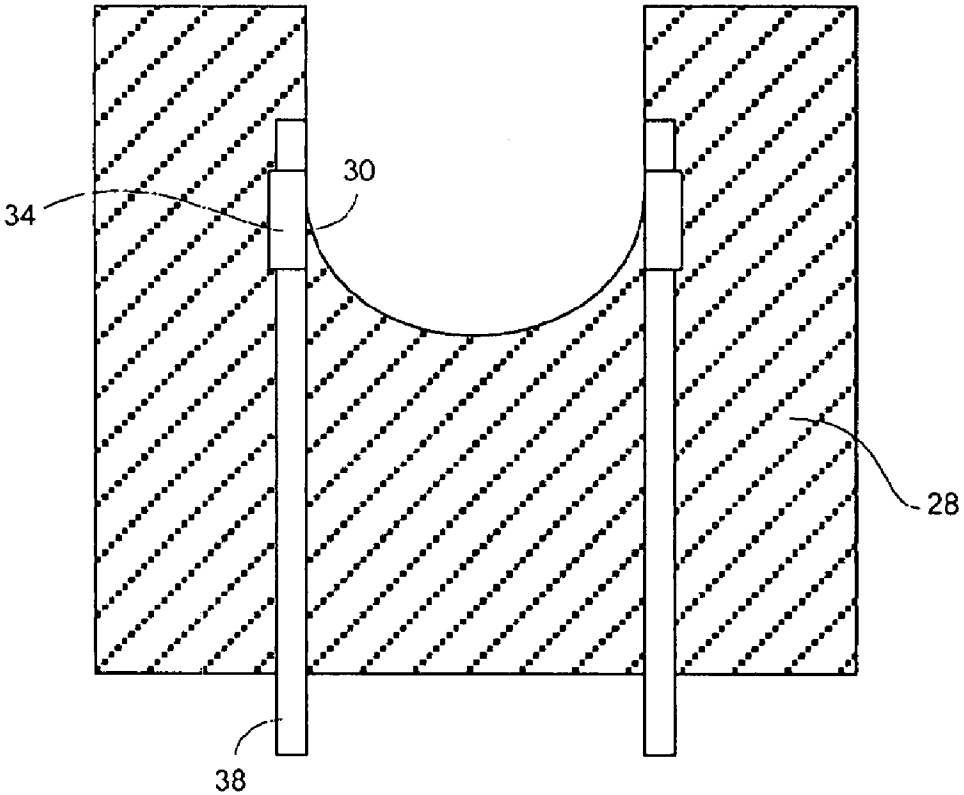
FIG. 8D is a side elevational view of a trench section in accordance with the present invention, shown with rebar extending in the leveling sleeves and installed in a surface.

The variable height of the floor of the interior fluid channel is best shown in FIGS. 8A-8C. For example, three exemplary trench sections 82, 84 and 86 are illustrated in FIGS. 8A-8C. As shown, each of the exemplary trench sections 82, 84, 86 includes a pair of spaced apart exterior sidewalls 88 and 90 and an interior fluid channel which includes a floor 92. As illustrated in FIGS. 8A-8C, the distance "d"between the bottom of the floor 92 of the fluid channel and the top of the exterior sidewalls 88, 90 is varied. In this way, a trench drain system is formed with a fluid channel with a pre-sloped floor that can be installed in a level trench.

Figure 9C:
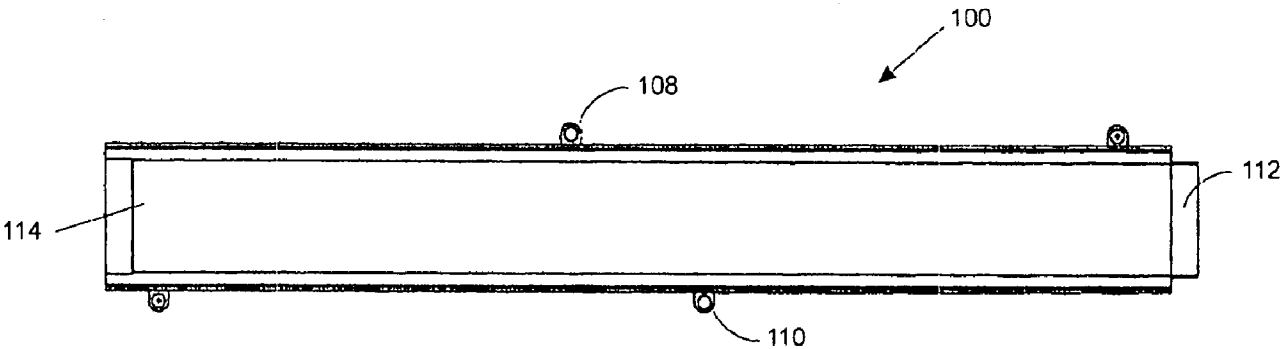
FIG. 9C is a top plan view of the trench section illustrated in FIG. 9A.
Figure 9A:
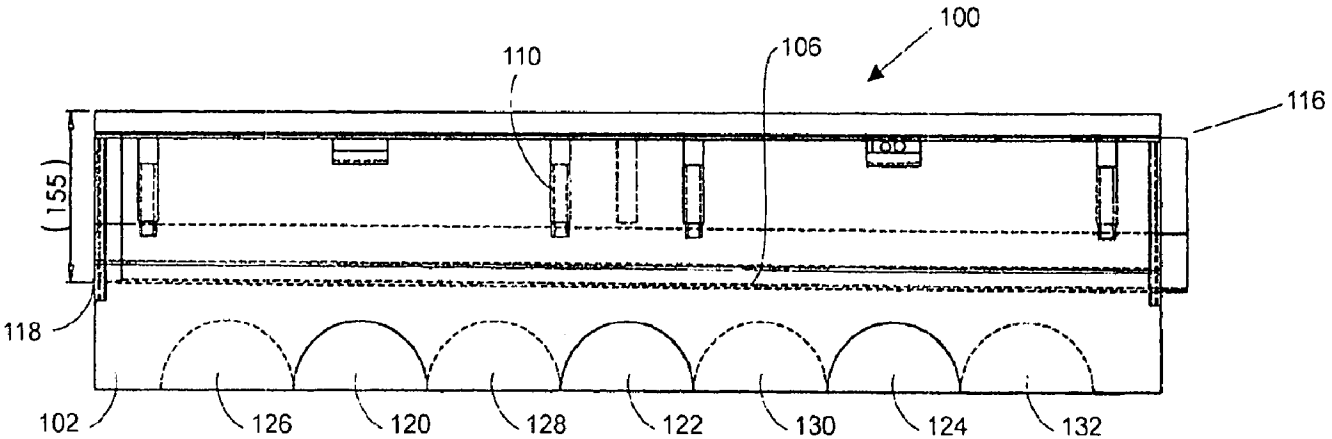
FIG. 9A is a front elevational view of an exemplary trench section in accordance with the present invention, shown with the sloping fluid channel floor in dotted line.
Figure 9B:
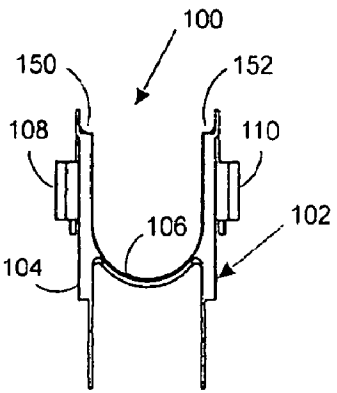
FIG. 9B is a side elevational view of the trench section illustrated in FIG. 9A.

FIGS. 9A-9C and 10A-10D illustrate the features of the different trench sections in more detail. Referring first to FIGS. 9A-9C, an exemplary trench drain section 100 is illustrated. As shown in FIG. 9B, the trench drain section 100 includes a pair of spaced apart parallel sidewalls 102, 104 and is formed with an interior fluid channel defining a floor 106. As discussed above, one or more leveling sleeves 108, 110 may be formed on the exterior sidewalls 102, 104.

In order to facilitate coupling of contiguous trench drain sections 100, one end of the trench drain section 100 may be formed with an extending tongue 112, formed in the shape of the interior fluid channel. An opposing end of the trench drain section 100 is formed with a corresponding indentation 114. As such, trench drain sections 100 may be quickly and easily coupled together by inserting the extending tongue 112 of one trench drain section 100 into the recess 114 of a contiguous trench drain section.

As mentioned above, each end of the trench drain section 100 includes an extending rib 116, 118. As shown in FIG. 9A, the tongue 112 extends outwardly from the extending rib 116. Thus, when the tongue 112 of a drain section is inserted into the indentation 114 of a contiguous drain section, the ribs 118 on the exterior sidewalls of the two trench drain sections will be side by side to enable a clip 220 (FIG. 14A) to be slipped over the extending ribs 116, 118 (FIG. 9A) on the contiguous trench drain sections to fasten them together.

In accordance with another feature of the invention, a bottom portion of each sidewall 102, 104 is formed with a plurality of space apart cutouts, for example, the cutouts 120, 122 and 124, shown in solid line in FIG. 9A. The opposing sidewall 104 is also provided with a number of space to part cutouts 126, 128, 130 and 132 along a bottom edge, shown in dotted line in FIG. 9A. The cutouts 120, 122 and 124, formed along the bottom edge of the sidewall 102, are staggered relative to the cutouts 126, 128, 130 and 132 on the opposing sidewall 104. Such a configuration allows concrete to flow under the trench drain section 100. By staggering the various cutouts on the two sidewalls 102, 104, the concrete will fill in all of the voids underneath the fluid channel 106.

FIG. 9A illustrates an exemplary trench drain section 100 in which the floor 106 of the fluid channel is pre-sloped. For example, the height of the floor of the fluid channel on an upstream end is 155 millimeters, on one end relative to the top of the sidewalls 102, 104 and 160 millimeters on a opposing downstream end.

Figure 7:
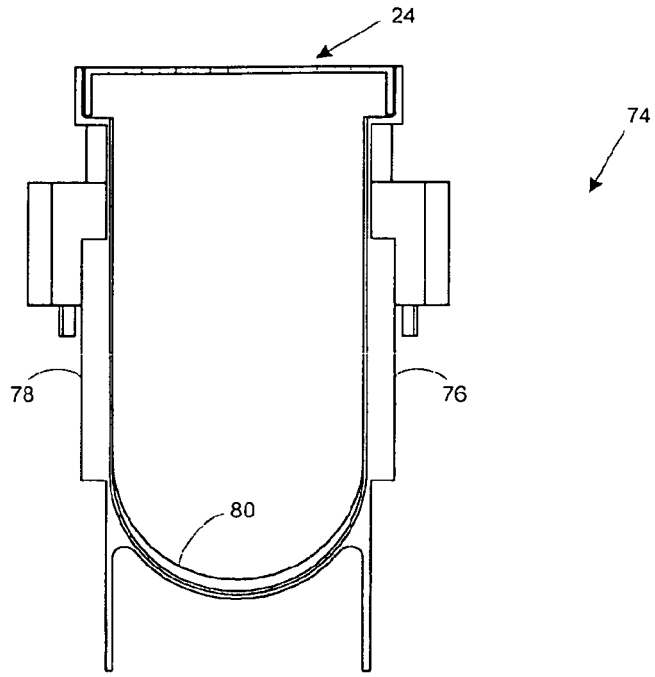
FIG. 7 is an end elevational view of an exemplary trench section in accordance with the present invention.

FIGS. 10A-10D illustrate an alternative trench drain section 134 having a different slope. Referring to FIG. 9B, a pair of shoulders 150, 152 are formed adjacent the top on the interior of the sidewalls 102 and 104. These shoulders are configured to receive a grate 24 (FIG. 7).

Figure 10A:
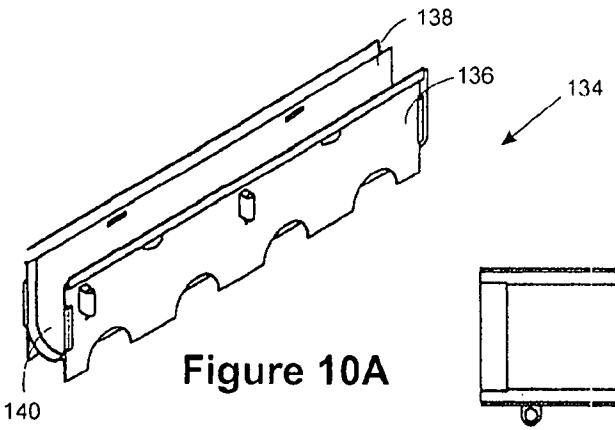
FIG. 10A is an isometric view of another exemplary trench section in accordance with the present invention.
Figure 10D:
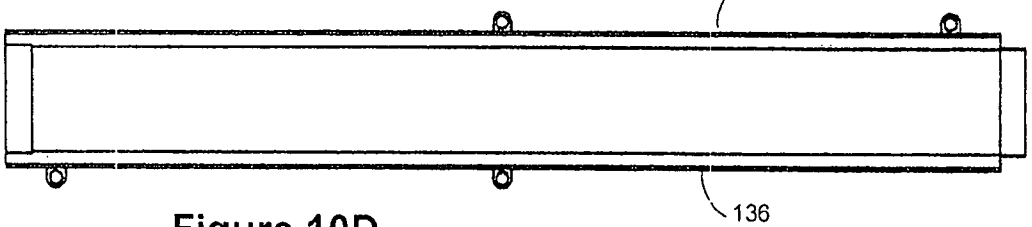
FIG. 10D is a top plan view of the trench section illustrated in FIG. 10A.
Figure 10B:
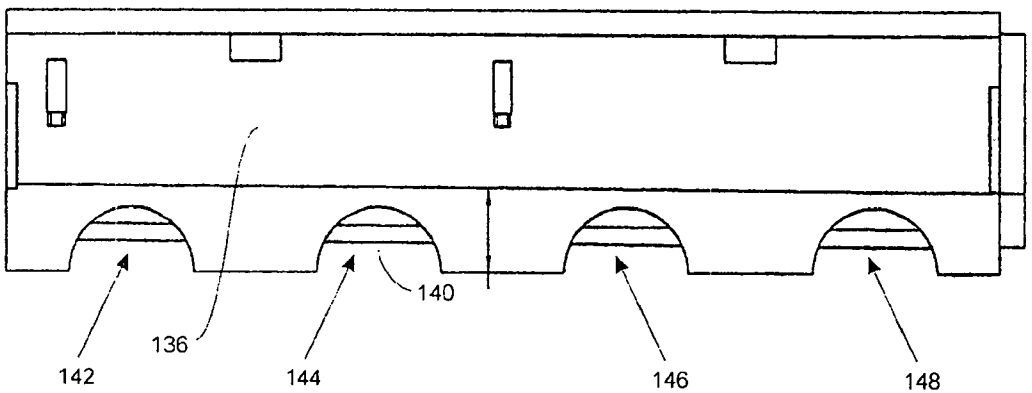
FIG. 10B is a front elevational view of the exemplary trench section illustrated in FIG. 10A, shown with the sloping conduit floor in solid line.
Figure 10C:
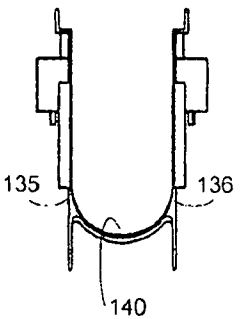
FIG. 10C is a side elevational view of the trench section illustrated in FIG. 10A.

Referring to FIGS. 10A-10D, the trench drain section 134 illustrates a configuration of a trench drain section having opposing sidewalls 136 and 138 and a fluid channel having a floor 138. The trench drain section 134 is formed with a plurality of cutouts 142, 144, 146 and 148. As best shown in FIG. 10B the floor 140 of the fluid channel extends below the height of the cutouts 142, 144, 146 and 148. Comparing the embodiments illustrated in FIGS. 9A-9C, and 10D, the floor of the fluid channel 106 (FIG. 9B) is above the cutouts 120-132 formed in the sidewalls 102, 104, respectively.

Exemplary Trench Drain Sections

The table below illustrates exemplary trench drain sections. As shown, the "Code" and the "Part No." columns represent exemplary code and part numbers for each of the trench drain sections. The "U" column illustrates the height of the upstream end of the floor of the fluid channel relative to the top of the exterior sidewalls in millimeters. The "D" column illustrates the height of the floor of the fluid channel relative to the height of the exterior sidewalls in millimeters. The "length" column represents exemplary lengths for the trench drain sections in meters, for example.

| Code | Part No. | U | D | Length |
|---|---|---|---|---|
| 1000N | 150150 | 0.150 | 0.150 | 1.000 |
| 1001 | 150155 | 0.150 | 0.155 | 1.000 |
| 1002 | 155160 | 0.155 | 0.160 | 1.000 |
| 1003 | 160165 | 0.160 | 0.165 | 1.000 |
| 1004 | 165170 | 0.165 | 0.170 | 1.000 |
| 1005 | 170175 | 0.170 | 0.175 | 1.000 |
| 1005N | 175175 | 0.175 | 0.175 | 1.000 |
| 1006 | 175180 | 0.175 | 0.180 | 1.000 |
| 1007 | 180185 | 0.180 | 0.185 | 1.000 |
| 1008 | 185190 | 0.185 | 0.190 | 1.000 |
| 1009 | 190195 | 0.190 | 0.195 | 1.000 |
| 1010 | 195200 | 0.195 | 0.200 | 1.000 |
| 1010N | 200200 | 0.200 | 0.200 | 1.000 |
| 1011 | 200205 | 0.200 | 0.205 | 1.000 |
| 1012 | 205210 | 0.205 | 0.210 | 1.000 |
| 1013 | 210215 | 0.210 | 0.215 | 1.000 |
| 1014 | 215220 | 0.215 | 0.220 | 1.000 |
| 1015 | 220225 | 0.220 | 0.225 | 1.000 |
| 1015N | 225225 | 0.225 | 0.225 | 1.000 |

The trench drain sections with the code numbers with an "N" suffix are not sloped. In other words, the upstream and downstream heights of the floor of the fluid channel are equal. The rest of the trench drain sections are successively sloped. The non-sloped trench drain sections are used for stepped configurations. The other trench drain sections are configured to provide a continuous slope. For example, the height of the floor of the fluid channel of the trench drain sections with the part number 150155 (code number 1001) is 0.150 meters of 150 millimeters (mm) on the upstream end. The downstream height is 0.155 meters or 155 mm. For an exemplary 1 meter length, the slope is (155 mm−150 mm)/1000 mm or 0.005. For a trench drain two meters or longer, a trench drain section with part number 155160 (code number 1002) would be attached to the part number 150155 trench drain section. In the case of the part number 155160 trench drain section, the upstream height of the floor of the fluid channel is 155 mm, which matches the downstream height of the part number 150155, configured with a matching 155 mm floor height.

Figure 18:
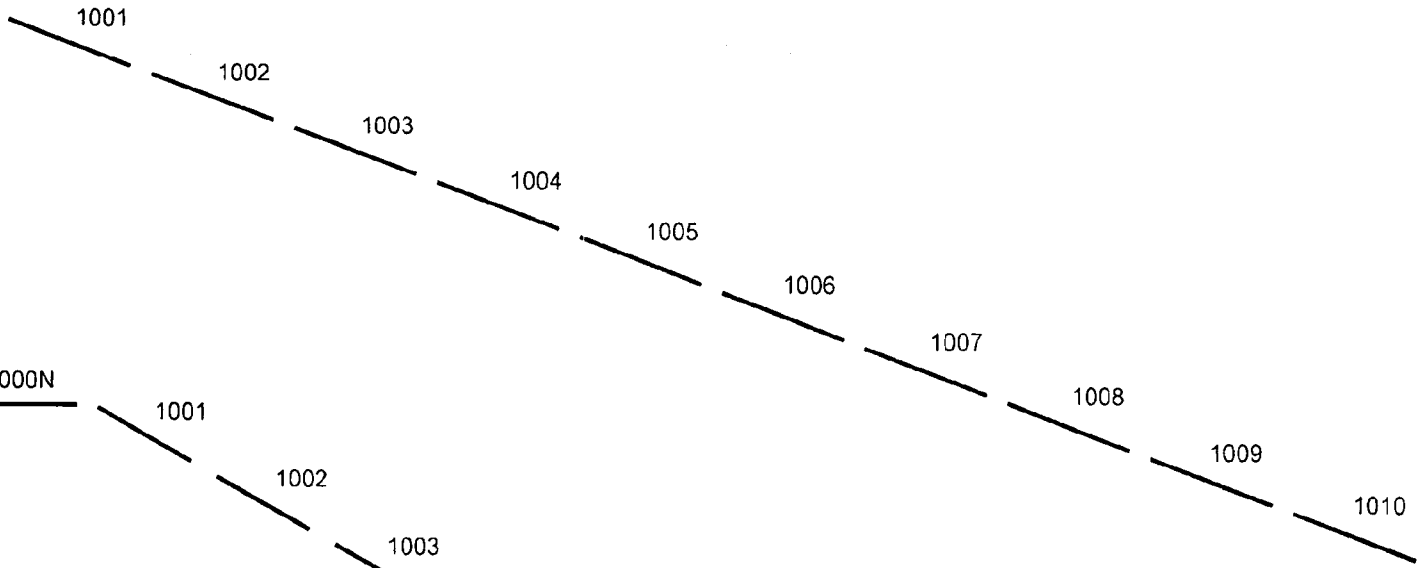
FIG. 18 is a simplified diagram of a 10-meter trench with a continuous slope which identifies the code numbers of the exemplary trench sections identified in the table.
Figure 19:
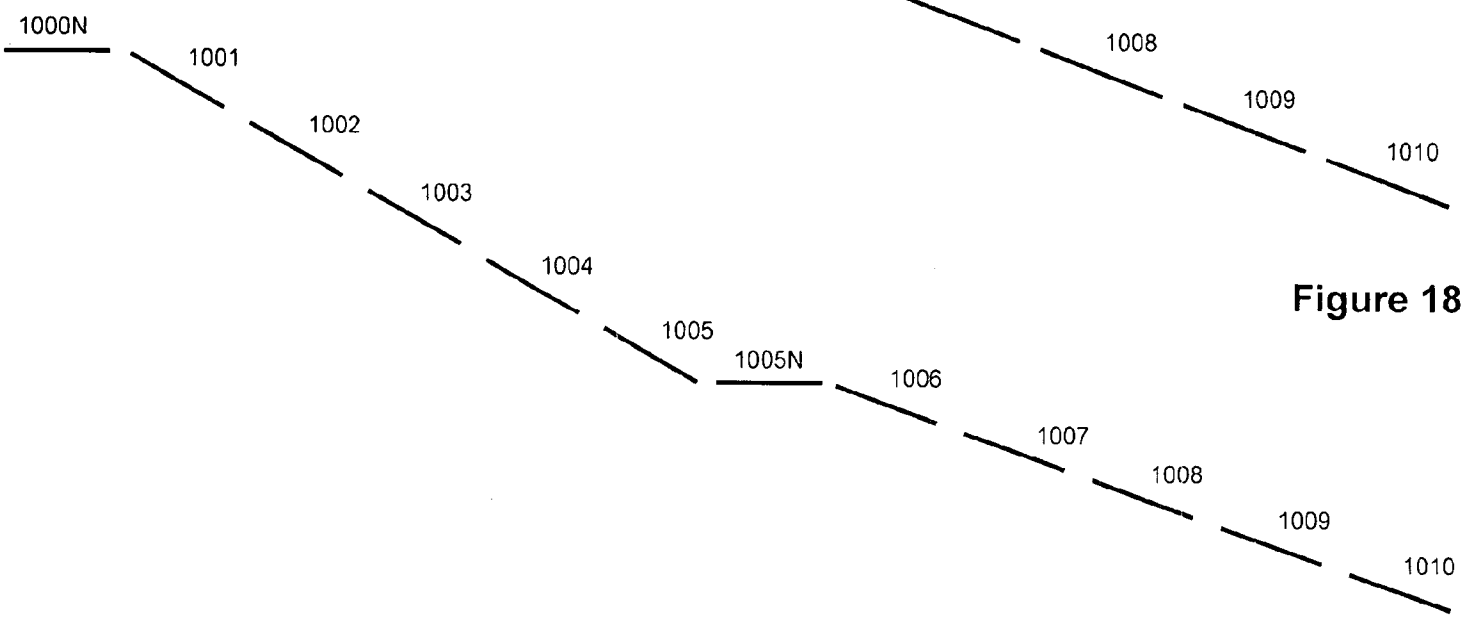
FIG. 19 is similar to FIG. 18, but illustrates a stepped slope configuration.

The trench drain sections are configured to provide a continuous slope, as shown in FIG. 18, or a stepped slope, as shown in FIG. 19. For a continuous slope, successive sloped trench drain sections are simply coupled together. For example, a 10 meter trench drain would be configured with 10 trench drain sections, for example, code numbers 1001-1002-1003-1004-1005-1006-1007-1008-1009-1010. A stepped slope configuration includes a number on non-sloped sections, for example a stepped slope configuration could be assembled from trench drain sections with the code numbers 1000N-1001-1002-1003-1004-1005-1005N-1006-1007-1008-1009-1010 to form a 12-meter trench drain.

Figure 20:
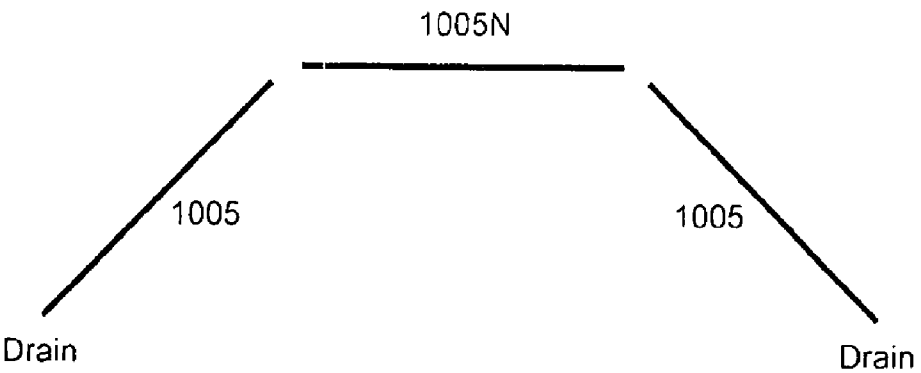
FIG. 20 is a simplified diagram of a two-slope trench drain system configured to connect common trench drains at each end which identifies the code numbers of the exemplary trench sections identified in the table.
Figure 21:
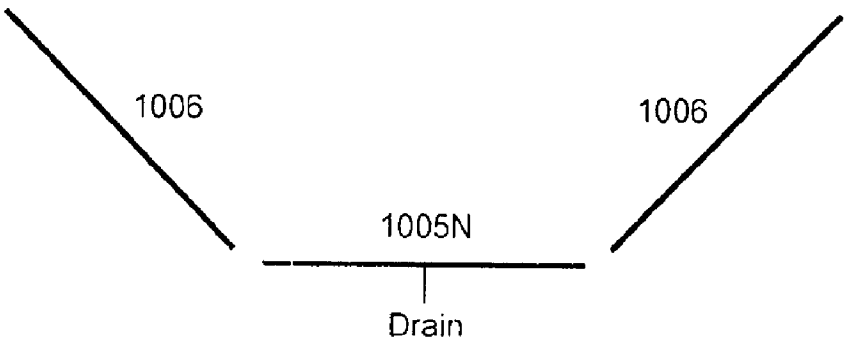
FIG. 21 is similar to FIG. 20, but for a configured connection to a center common drain.

As mentioned above, the trench drain system can also be used to form trench drains with multiple slopes, as shown in FIGS. 20 and 21. In particular, FIG. 20 illustrates a configuration in which the exemplary trench drain sections, illustrated in the table above, are used to form a multiple slope trench drain with connections to a common drain at each end. FIG. 21 illustrates a configuration of a multiple slope trench drain in which the ends of the drain are sloped to the center and the common drain is connected to the center.

In each of the multiple slope configurations discussed above, the trench drain sections may be formed similar to the trench drain section 100 (FIG. 9B) and include an extending tongue 112 (FIG. 9C) on one end and an indentation 114 on the opposing end. In such an application, two of the three trench sections are modified in the field to remove the extending tongues since the center section only has a single indentation 114 on one end. Alternatively, the non-sloped trench section can be formed with indentations 114 on both ends.

Outlet End Cap

Figure 11A:
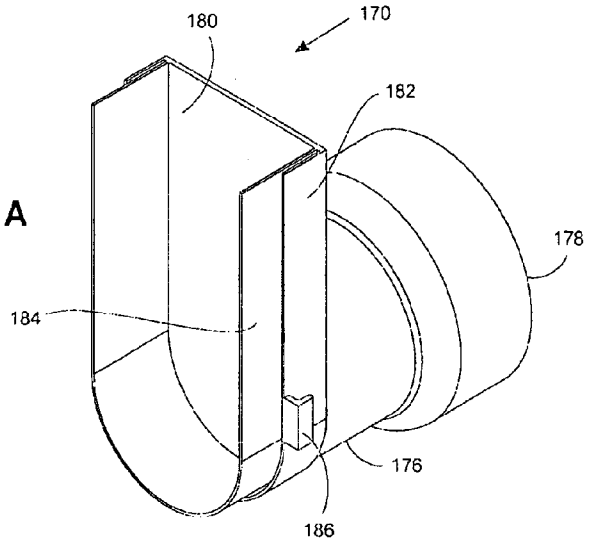
FIG. 11A is an isometric view of an outlet end cap in accordance with the present invention.
Figure 11B:
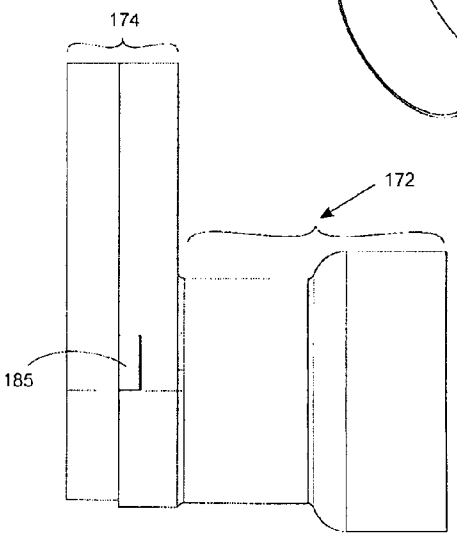
FIG. 11B is a side elevational view of the outlet end cap illustrated in FIG. 11A.
Figure 11C:
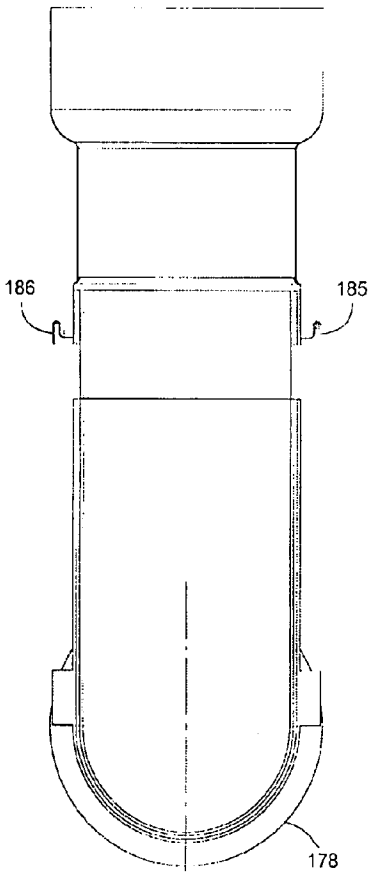
FIG. 11C is a top plan view of the outlet end cap illustrated in FIG. 11A.

An exemplary outlet end cap is illustrated in FIGS. 11A-11C, and generally identified with the reference numeral 170. The outlet end cap 170 includes a nozzle portion 172 and an end cap portion 174. As shown, the nozzle portion 172 may be formed with a first portion having 176 having a first diameter and a second portion 178 having a relatively larger diameter. In this way, a single outlet end cap 170 can be used for connection to two different size drain systems. As best shown in FIG. 11A, the outlet end cap portion 174 includes end cap portion 174 and an extending flange portion 182. A tongue 184 is formed radially outwardly from the extending flange portion 182 in order to facilitate connection of the outlet end cap 170 to a trench drain section by inserting the extending tongue 184 in a recessed portion 114 (FIG. 9C) of a contiguous trench drain section.

The outlet end cap 170 may be provided with a solid end cap portion 180 as shown. In such an application, the outlet end cap 170 may be used as a closure for an upstream trench drain section. In other application, such as an application in which the outlet end cap 170 is used for connection to an external common drain system, a keyhole saw may be used to cut a hole in the end cap portion 180.

As mentioned above, the outlet end cap 170 is formed with a pair of extending ribs 184, 186 on the flange portion 182. These extending ribs 185, 186 allow the outlet end cap 170 to be attached to either a trench drain section or a catch basin, also shown in FIG. 1.

As mentioned above, the outlet end cap 170 is configured to be mechanically coupled either to a trench drain section or to a catch basin. In applications where the outlet end cap 170 is connected to a trench drain section, the extending tongue 184 is inserted into a corresponding indented portion of the trench drain section such that the extending ribs 185 and 186 on the outlet end cap 170 are adjacent to the corresponding ears on the trench drain section. A clip as mentioned above is used to secure the outlet end cap 170 to the trench drain section.

In an alternative embodiment used for connection to a horizontal common drain pipe, the outlet end cap 170 may be attached to a catch basin, for example, as illustrated in FIG. 1. In this application, the extending tongue 184 is cut off. In addition, a keyhole saw is used to cut a hole in the wall 180 of the end cap portion 174. A corresponding hole is formed and one sidewall of the catch basin and aligned with the hole in the wall 180. In this application the outlet end cap 170 is attached to the sidewall of the catch basin 32 (FIG. 1) with various adhesive or by way of a solvent weld type joint.

Bottom Pipe Outlet

Figure 12A:
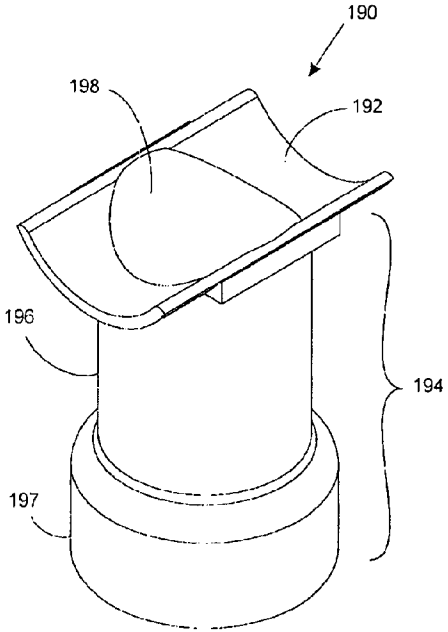
FIG. 12A is an isometric view of an bottom pipe outlet in accordance with the present invention.
Figure 12B:
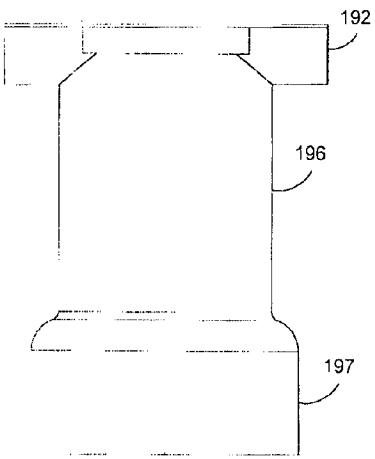
FIG. 12B is a front elevational view of the bottom pipe outlet illustrated in FIG. 12A.
Figure 12D:
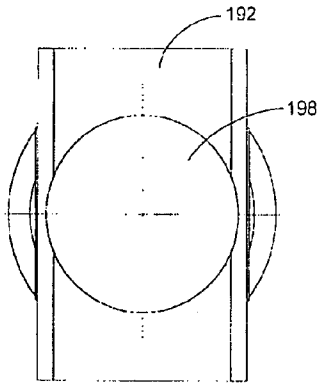
FIG. 12D is a top plan view of the bottom pipe outlet illustrated in FIG. 12A.
Figure 12C:
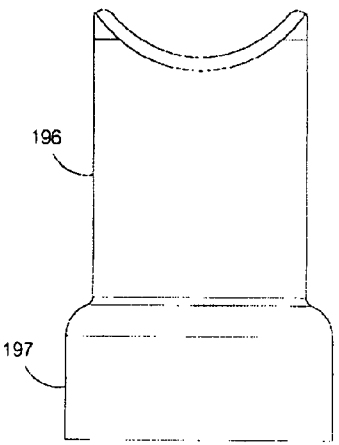
FIG. 12C is a side elevational view of the bottom pipe outlet illustrated in FIG. 12A.

A bottom pipe outlet 190 is illustrated in FIGS. 12A-12B, which can be installed anywhere along the length of a trench drain section or catch basin. The bottom pipe outlet 190 includes a saddle portion 192 and a nozzle portion 194. The nozzle portion 194 includes a relatively smaller diameter pipe 196 and a relatively larger diameter pipe portion 197 to allow the bottom pipe outlet 190 to be used with two different size pipes, for example, three inch or four inch pipes. The bottom pipe outlet 190 is configured for use in applications where connection to a common drain will be from the bottom of the catch basin or bottom of a trench section. In this application, the saddle portion 192 is configured in generally the same shape as the bottom floor of the fluid inlet portion of the trench drain section and the bottom portion of the catch basin. A keyhole saw is used to cut a hole in either the catch basin or the bottom floor of the trench drain section. The bottom pipe outlet 190 is then placed on the bottom of the catch basin or trench drain section in a line so that it's central aperture 198 is aligned with the aperture formed in either the trench drain section or the catch basin. The bottom pipe outlet may then be secured by way of a conventional solvent weld.

Catch Basin

Figure 13A:
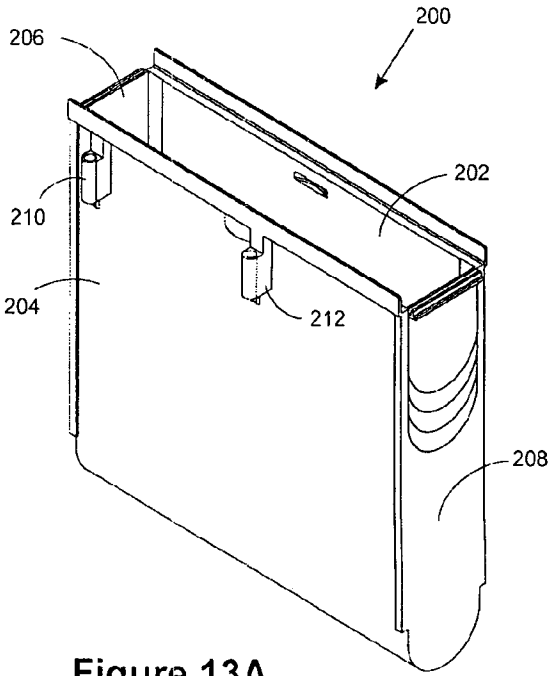
FIG. 13A is an isometric view of a catch basin in accordance with the present invention.
Figure 13B:
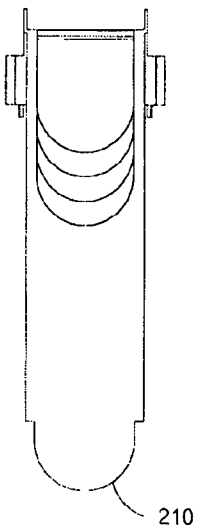
FIG. 13B is a side elevational view of the catch basin illustrated in FIG. 13A.
Figure 13C:
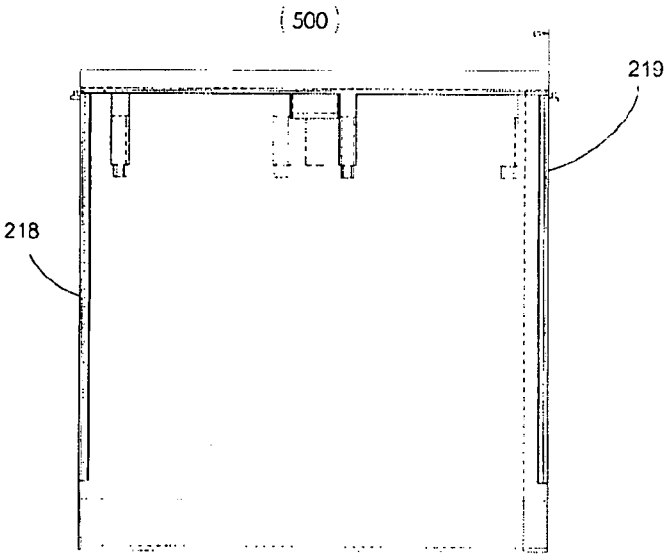
FIG. 13C is a front elevational view of the catch basin illustrated in FIG. 13A.
Figure 13D:
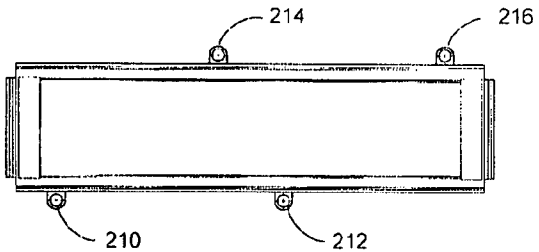
FIG. 13D is a top plan view of the catch basin illustrated in FIG. 13A.

An exemplary catch basin is illustrated in FIGS. 13A-13B and generally identified with the reference numeral 200. As shown, catch basin 200 is formed as a generally rectangular box which includes four walls 202, 204 and 206 and 208 and a bottom floor 210. The catch basin is used to receive drainage from one or more trench drain and is connected to a common drain as generally shown in FIG. 2. The opposing sidewalls 102 and 104 may be formed with extending sleeves 210, 212 with through holes for receiving rebar for leveling in a manner as generally discussed above. The catch basin 200 may be formed with extending ribs 218, 219 along its edges that are adapted to be aligned and disposed adjacent corresponding ribs on the edges of an adjacent trench drain section. As mentioned above, clips are used to secure the catch basin 200 to a trench drain section.

Clip

Figure 14A:
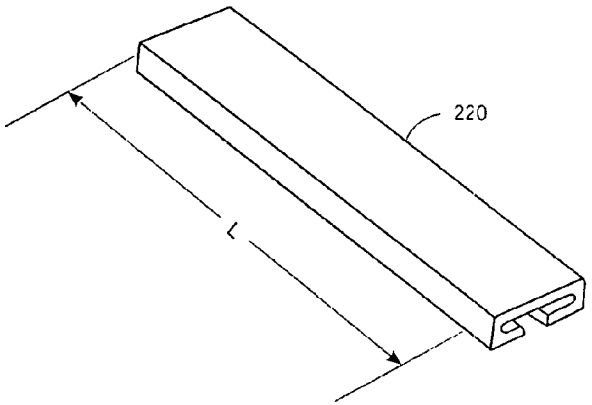
FIG. 14A is an isometric view of a combination clip/spacer in accordance with the present invention.
Figure 14B:
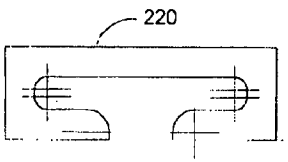
FIG. 14B is a side elevational view of the combination clip/spacer illustrated in FIG. 14A.
Figure 14C:
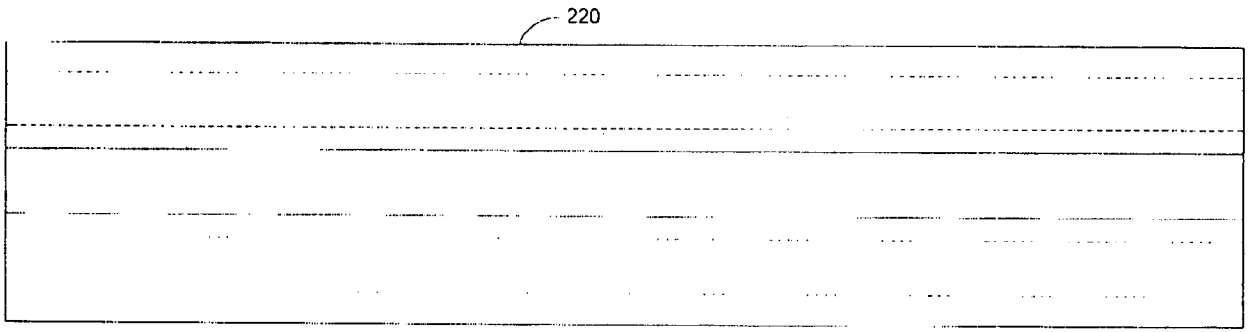
FIG. 14C is a top plan view of the combination clip/spacer illustrated in FIG. 14A.

An exemplary clip 220 is illustrated in FIGS. 14A-14C. The clip 220 is configured with a C-type cross section for receiving the extending ribs on the trench drain sections as well as the catch basin to secure those elements together. The clip 220 may be formed with an elongated length which allows it to be used as a spacer, for example, the spacer 40 illustrated in FIG. 1.

Method of Manufacturing

In accordance with an important aspect of the invention, the various modular mold sections can be injected molded. The various components used for the trench drain system in accordance with the present invention can be injected molded from various materials. For example, the trench drain sections, catch basin, and clip, can be molded from polypropylene (PPE) while the outlet end cap and bottom pipe outlet can be molded from polyvinyl chloride (PVC). The use of PVC for the bottom pipe outlet and the outlet end cap allows these components to be secured to external drain pipes, normally made from PVC, by solvent welding.

Figure 15A:
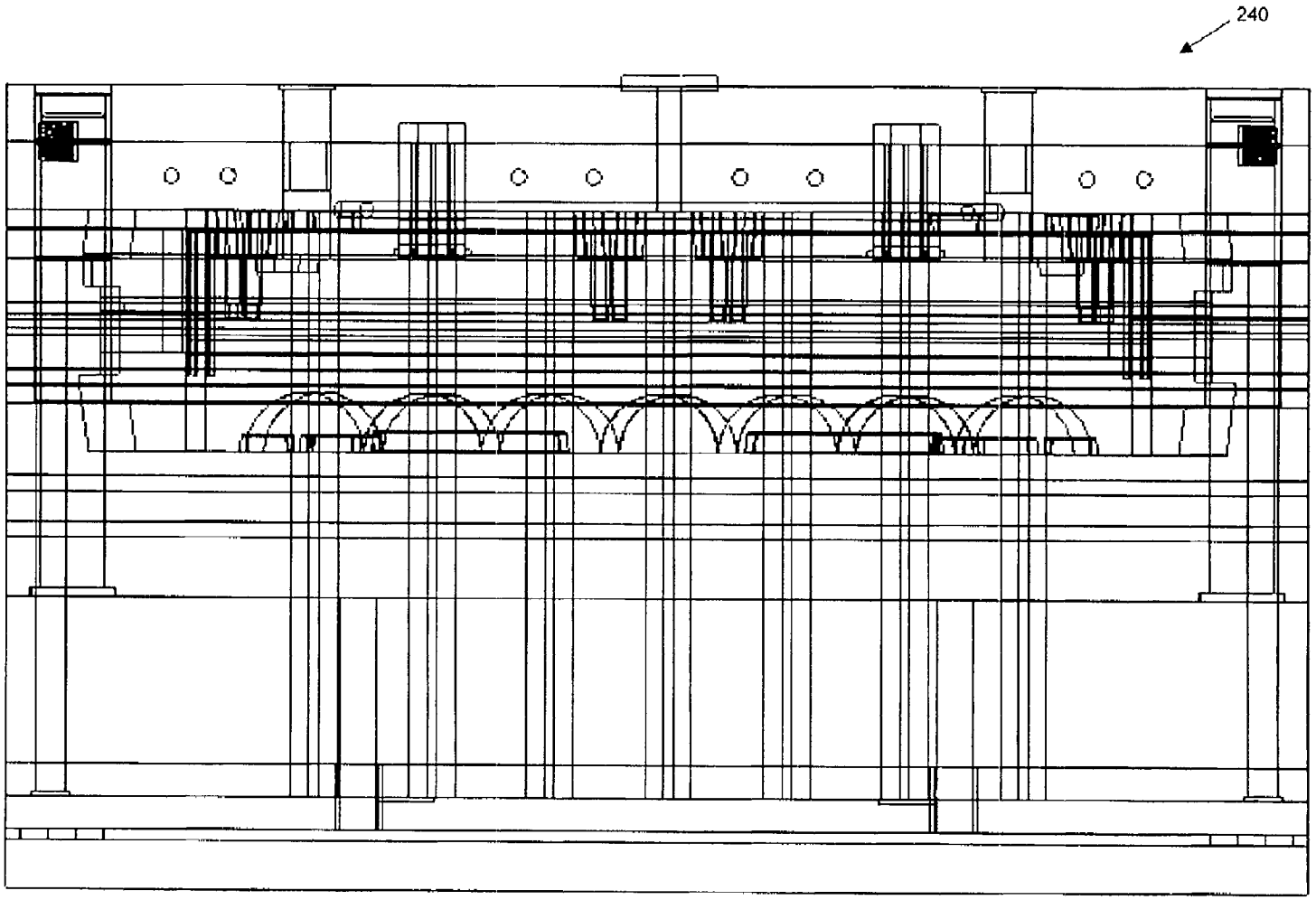
FIG. 15A is a side elevational view of a master mold for use with the present invention.
Figure 15B:
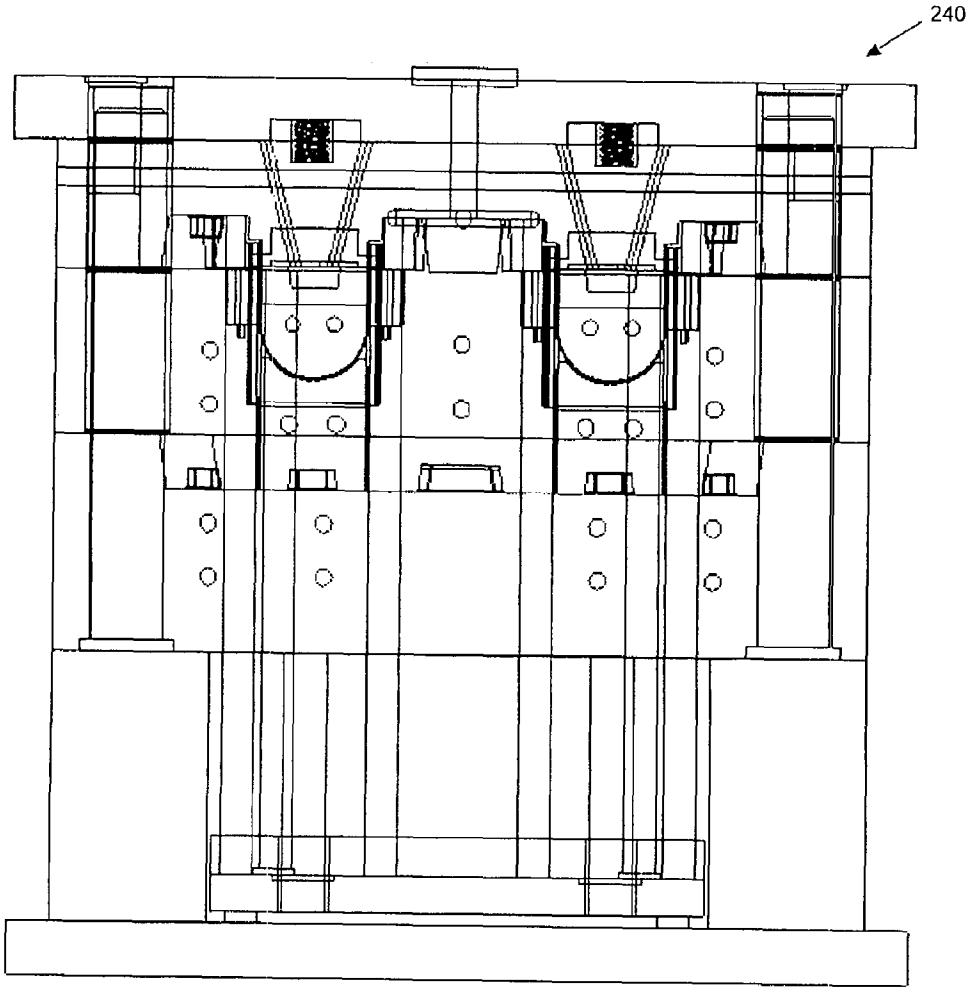
FIG. 15B is an end elevational view of a master mold for use with the present invention.
Figure 15C:
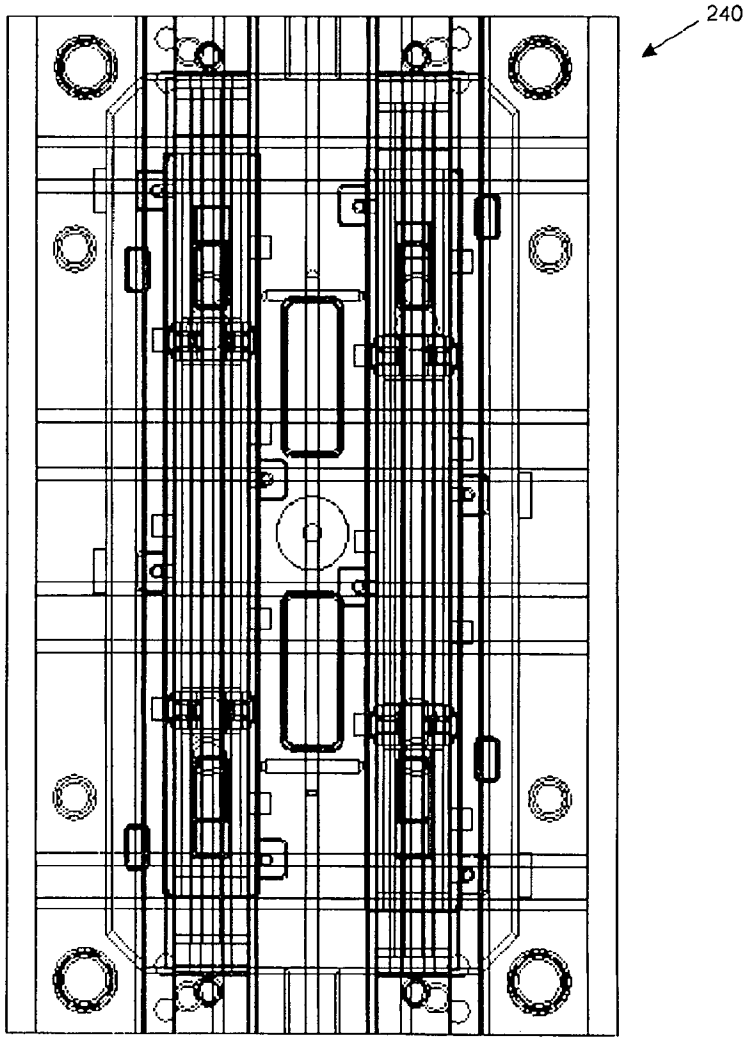
FIG. 15C is an top plan view of a master mold for use with the present invention.
Figure 16A:
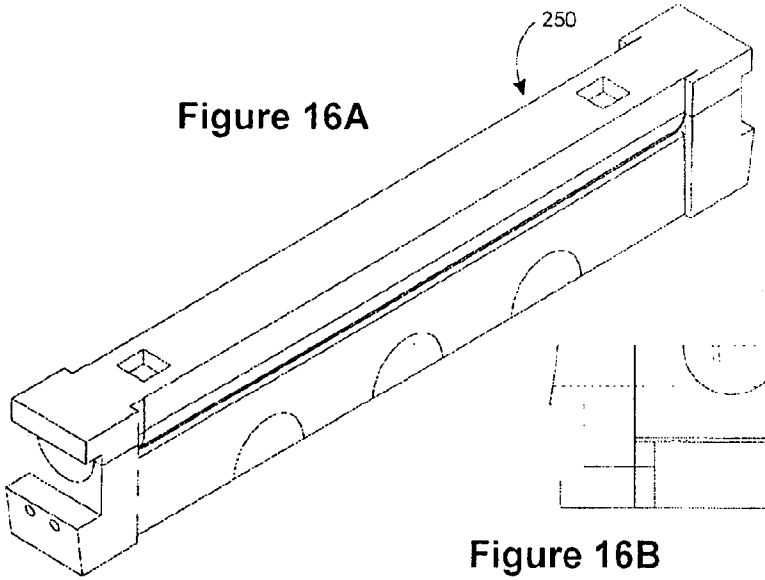
FIG. 16A is an isometric view of a mold insert in accordance with the present invention.
Figure 16B:
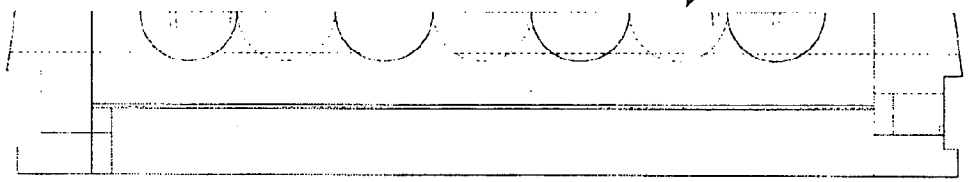
FIG. 16B is an elevational view of one side of the mold insert illustrated in FIG. 16A, shown rotated 180°.
Figure 16C:
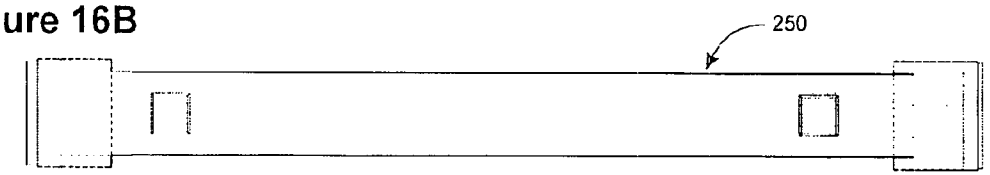
FIG. 16C is a top plan view of the mold insert illustrated in FIG. 16A.
Figure 16D:
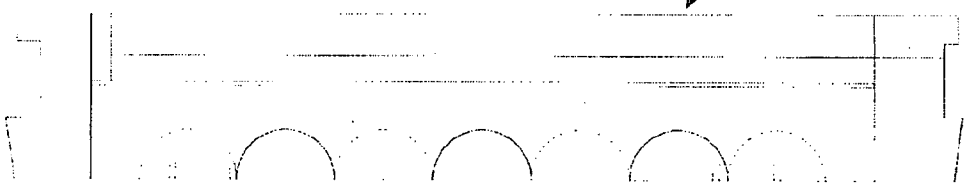
FIGS. 16D and 16E illustrate an elevational view of the other side of the mold insert illustrated in FIG. 16A and an end elevational view of the mold insert illustrated in FIG. 16A.
Figure 16E:
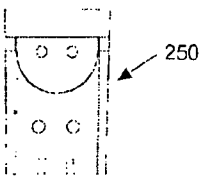

In accordance with an important aspect of the invention, the configuration of the trench drain sections requires only a single master mold 240 and relatively few mold inserts 250. For example, the table above lists nineteen (19) separate trench drain sections. These nineteen (19) different drain sections can be molded with a single master mold, for example, as illustrated in FIG. 15 and five mold inserts similar to the mold insert 250 illustrated in FIGS. 16A-16D.

The essential difference between the various trench drain sections is the slope of the floor of the fluid channel. Thus, the mold inserts are configured to provide the different slopes.

Obviously, many modifications and variations of the present invention are possible in light of the above teachings. Thus, it is to be understood that, within the scope of the appended claims, the invention may be practiced otherwise than as specifically described above.

I claim:

1. A trench drain system configured to be installed in a level trench comprising:

a plurality of trench drain sections, each of said trench drain sections configured with a pair of exterior, spaced apart sidewalls of uniform height and an interior fluid channel formed with a floor having a predetermined slope;

a catch basin coupled to an opposing end; and a fluid outlet coupled to said catch basin for discharge into a common drain, wherein said drain sections having different slopes have the same exterior height.

2. The trench drain system as recited in claim 1, wherein said plurality of trench drain sections are configured so that at least one end of said interior fluid channel is open.

3. The trench drain system as recited in claim 1, wherein said trench drain sections are formed with a uniform length.

4. The trench drain system as recited in claim 1, wherein said one plurality of trench drain sections are formed with one or more leveling ears for leveling said trench drain section in the trench.

5. The trench drain system as recited in claim 1, wherein said plurality of trench drain sections are formed with said interior fluid channel that is open on each end.

6. The trench drain system as recited in claim 5, further including an outlet end cap configured to be coupled to one end of said trench drain section.

7. The trench drain system as recited in claim 5, wherein said outlet end cap is configured to close one end of said interior fluid channel.

8. The trench drain system as recited in claim 6, wherein said outlet end cap is formed with a nozzle for connection to an external drain.

9. The trench drain system as recited in claim 8, wherein said nozzle is formed to accommodate two pipe sizes.

10. The trench drain system as recited in claim 8 wherein said nozzle is configured for connection to the external drain generally parallel to said trench drain system.

11. The trench drain system as recited in claim 1, wherein ribs are formed on the exterior of said spaced apart sidewalls, said ribs disposed generally transverse to a longitudinal axis of the trench drain section; said ribs used for coupling adjacent trench drain sections to together.

12. The trench drain system as recited in claim 1, further including a bottom pipe outlet.

13. The trench drain system as recited in claim 12, wherein said bottom pipe outlet is formed with a saddle to enable it to be disposed under the floor of the interior fluid channel.

14. A trench drain system comprising:

at least two trench drain sections, each formed from exterior sidewalls and an interior fluid channel having a floor wherein said trench drain sections are configured so that the floor of said interior fluid channel is pre-sloped, wherein drain sections having different slopes have the same exterior height.

15. The trench drain system as recited in claim 14, further including one trench drain section configured with the interior fluid channel having no slope.

16. The trench drain system as recited in claim 14, wherein said trench drain sections are configured so that contiguous trench drain sections have a continuous slope.

17. The trench drain system as recited in claim 15, wherein said trench drain sections are configured in a stepped slope configuration.

18. The trench drain system as recited in claim15, wherein said trench drain sections are configured with slopes in different directions.

19. The trench drain system as recited in claim 18, further including two outlet end caps and said trench drain system is configured to enable connections to external drains at each end of said trench drain system.

20. The trench drain system as recited in claim 19, wherein said trench drain sections are configured to be sloped toward said outlet end caps.

21. The trench drain system as recited in claim 18, wherein said trench drain sections are configured to be sloped toward a location spaced away from the ends of said trench drain system and further including a bottom pipe outlet for enabling a connection to an external drain pipe.

22. A method of making a plurality of trench drain sections having exterior sidewalls and an interior fluid channel having a pre-sloped floor, the method comprising the steps of:

(a) providing a single master mold;

(b) providing one or more mold inserts; and (c) molding said plurality of trench drain sections using said single master mold and said one or more mold inserts, said mold and said one or more mold inserts being configured so that trench sections with different pre-sloped floors have the same exterior height.

23. The method as recited in claim 22 wherein step (c) comprises:

(c) molding nineteen (19) different trench drain sections.

24. The method as recited in claim 23 wherein step (b) comprises:

(b) providing five (5) mold inserts.

* * * * *